US007455099B2

(12) United States Patent
Osborn et al.

(10) Patent No.: US 7,455,099 B2
(45) Date of Patent: Nov. 25, 2008

(54) HEAT EXCHANGER PERFORMANCE MONITORING AND ANALYSIS METHOD AND SYSTEM

(75) Inventors: Mark David Osborn, Schenectady, NY (US); Vijaysai Prasad, Karnataka (IN); Lijie Yu, Clifton Park, NY (US); Venkatarao Ryali, Karnataka (IN); Sunil Shirish Shah, Karnataka (IN); Ivy Wai Man Chong, Richmond, VA (US); Shirley Suet-Yee Au, Mt. Laurel, NJ (US); Nishith Pramod Vora, Warminster, PA (US)

(73) Assignee: General Electric Company, Niskayuna, NY (US)

( * ) Notice: Subject to any disclaimer, the term of this patent is extended or adjusted under 35 U.S.C. 154(b) by 553 days.

(21) Appl. No.: 10/879,459

(22) Filed: Jun. 29, 2004

(65) Prior Publication Data

US 2005/0133211 A1 Jun. 23, 2005

Related U.S. Application Data

(60) Provisional application No. 60/531,235, filed on Dec. 19, 2003.

(51) Int. Cl.
*G01B 3/44* (2006.01)
*G01B 3/52* (2006.01)

(52) U.S. Cl. ..... 165/11.1; 165/95; 702/34; 702/50; 702/51; 702/181; 702/182; 702/183; 702/185; 702/191; 374/170

(58) Field of Classification Search ..... 702/81, 702/34, 51, 52, 181, 182, 183, 185, 191; 374/170; 165/11.1, 95
See application file for complete search history.

(56) References Cited

U.S. PATENT DOCUMENTS

| | | | | |
|---|---|---|---|---|
| 2,802,624 | A * | 8/1957 | Kayan | 702/182 |
| 5,005,351 | A | 4/1991 | Archer et al. | |
| 5,353,653 | A | 10/1994 | Watanabe et al. | 73/865.9 |
| 5,590,706 | A | 1/1997 | Tsou et al. | |
| 5,615,733 | A | 4/1997 | Yang | 165/11.1 |
| 6,386,272 | B1 | 5/2002 | Starner et al. | 165/11.1 |
| 6,408,227 | B1 | 6/2002 | Singhvi et al. | 700/266 |

(Continued)

OTHER PUBLICATIONS

Zolker, K. et al.; "Einsatz Des Kessel-Diagnode-Systems Kedi Im Kraftwerk Staudinger 5.Orealisierung Und Betriebserfahrung"; Sep. 1, 1995, VGB Kraftwerkstechnik, VGB Kraftwerkstechnik GMBH. Essen, De, pp. 755-762.

*Primary Examiner*—John K Ford
(74) *Attorney, Agent, or Firm*—Fletcher Yoder

(57) ABSTRACT

A technique is disclosed for evaluating and monitoring performance of a heat exchanger system. Operating parameters of the system are monitored and fouling factors for heat transfer surfaces of the exchanger are determined. Trending of fouling may be performed over time based upon the fouling factors, and a model of fouling may be selected from known sets of models, or a model may be developed or refined. Fluid treatment, such as water treatment regimes may be taken into account in evaluation of fouling. An automated knowledge based analysis algorithm may diagnose possible caused of fouling based upon sensed and observed parameters and conditions. Corrective actions may be suggested and the system controlled to reduce, avoid or correct for detected fouling.

7 Claims, 4 Drawing Sheets

U.S. PATENT DOCUMENTS 6,415,276 B1 * 7/2002 Heger et al. ..... 706/52
6,526,358 B1 * 2/2003 Mathews et al. ..... 702/51
6,735,549 B2 * 5/2004 Ridolfo ..... 702/181
6,799,124 B2 * 9/2004 Perdue et al. ..... 702/34
6,962,436 B1 * 11/2005 Holloway et al. ..... 374/170
2003/0065454 A1 4/2003 Perdue et al.
2004/0102924 A1 5/2004 Jarrell et al.

* cited by examiner

HEAT EXCHANGER PERFORMANCE MONITORING AND ANALYSIS METHOD AND SYSTEM

CROSS REFERENCE TO RELATED APPLICATIONS

The present patent application claims priority of the provisional patent application No. 60/531,235, filed on Dec. 19, 2003, and entitled "HEAT EXCHANGER PERFORMANCE MONITORING AND ANALYSIS METHOD AND SYSTEM"

BACKGROUND

The present invention relates generally to heat exchanging devices. More particularly, the invention relates to techniques for monitoring thermal performance of heat exchangers, analyzing reasons for changes in performance over time, and ameliorating performance.

Heat exchanging systems are employed across a wide range of applications and industries. In general, such systems serve to transfer thermal energy between two process fluids. The fluids may be of many different types, and many systems employ water or steam for at least one of the fluids. The direction of thermal transfer is typically determined based upon which fluid is to be heated or cooled in the particular application. In practice, the fluids may undergo sensible heat changes (i.e. exhibiting changes in temperature), latent heat changes (i.e. causing changes in phase), or both.

Many different types of heat exchangers are known and in use. For example, in one common design tubes extend from one end of a shell to another to establish one or more passes of one fluid through the other. One of the fluids is then routed though the tubes, while the second is circulated through the shell. The tubes serve to isolate the fluids from one another and to transfer thermal energy between the fluids. The rate of heat transfer depends on factors such as the flow rate of the fluids, their inlet and outlet temperatures, individual heat transfer coefficients, over all heat transfer coefficients etc. Other types of heat exchangers operate on different principles, such as evaporation or condensation (i.e. phase change) of one or both fluids.

Design parameters for heat exchangers are typically determined on an application-specific basis. That is, based upon the needs for thermal transfer, the fluids to be heated and cooled, environment within which the systems will operate, and the desired life of the equipment, desired material, styles and operating specifications are determined. Moreover, design parameters generally assume ranges of tolerance in operating conditions and performance, including the efficiency and rates of heat transfer between the circulating fluids.

One difficulty that arises in heat exchanger systems is the loss of the heat transfer capabilities over time. Reduction in the rate of heat transfer may result from a number of root causes, and is often related to fouling of the exchanger paths and heat transfer surfaces. Underlying causes of fouling may include such factors as deposition of materials within the flow paths or on the heat transfer surfaces, chemical reactions within the exchanger, precipitation of materials, particulate matter within the exchanger, corrosion of the exchanger materials, biological growth or deposition, and so forth.

Certain approaches have been developed to characterize such fouling and to avoid it. For example, certain factors have been tracked as indicators of fouling so as to permit servicing when performance falls below desired levels. In systems in which water constitutes one of the process streams, the water is typically treated with chemicals to prevent or to reduce the occurrence of chemical deposition, chemical reactions, and so forth. However, such approaches have been somewhat limited in their ability accurately to characterize the causes of fouling, and they do not provide adequate tools for evaluating trends, broadly diagnosing system factors leading to fouling, or prognosticating changes that could improve efficiency, reduce downtime for servicing, and avoid or reduce related costs. Many current systems are simply inadequate due to insufficient monitoring of process parameters needed to generate early warnings of impending problems, the inability to diagnose causes of degradation or failures, and the lack of diagnostic and predictive know-how to tie the correct diagnosis to effective corrective actions.

There is a need, therefore, for improved techniques for monitoring and characterizing heat exchanger performance. The need is particularly prevalent, in that heat exchangers are found in such a wide variety of industries, including chemical plants, polymer processes, air separation plants, refineries, hotel chains and building management concerns, to name but a few. Consequences of failing to accurately control heat exchanger performance include high energy consumption, loss of production capacities, increased occurrences of shutdowns, and cleaning costs. Moreover, in extreme cases, failure of the heat exchanger may result, causing rupture and leaks, resulting in environmental concerns and equipment maintenance or replacement costs.

SUMMARY

Embodiments of the invention provide a novel approach to heat exchanger performance monitoring designed to respond to such needs. In accordance with aspects of the invention is provided a comprehensive package of sensors, remote monitoring devices, calculation engines, user interface, and treatment control. The full system, or any sub-components thereof, may be installed on any field heat transfer equipment for monitoring and diagnosis. Since both in-line or non-intrusive sensors may be used, the system can be installed without shut-downs if desired, and the components are highly portable.

The techniques allow for both monitoring and characterization of performance and fouling factors, as well as the ability to predict performance and propose corrective actions. The techniques provide a comprehensive remote monitoring, diagnostic and interface package. In certain embodiments, two diagnostic and prognostic approaches are employed, including a first-principles fouling factor model and a Bayesian network. These models use as inputs factors such as process conditions, laboratory test results, design and environmental information, expert's knowledge. Outputs of the analysis may be presented to the user on a web interface in the form of alarms or an intelligent advisor. Notification may thus be provided in the form of, for example, early failure warnings, identification of probable causes for degradation of performance, recommendations for corrective actions, and prediction of the heat exchanger's future performance.

In accordance with certain aspects, the techniques permit the evaluation of fouling trends. Characterization of the separate rates and degrees of fouling is thus possible. Moreover, diagnosis of the separate root causes of fouling on both surfaces may be performed, and separate or interdependent corrective actions may be prescribed.

The techniques also allow for trending of fouling. Based upon sensed and calculated fouling rates, a fouling model may be developed or selected from multiple available models.

The fouling model may then be used to predict progression of fouling and loss of efficiency or thermal transfer effectiveness. Again, such analysis may also serve to determine corrective actions, and the trending may take into account such actions and their effects on predicted fouling rates.

An embodiment of the invention also offers a complete solution to heat exchanger fouling management. The solution can be installed on any field system, including operating systems and plants, even without shut-down in certain cases, or with minimal shutdowns, as for sensor installation. The sensors may be non-intrusive or in-line types, such that the system may be used with virtually any field heat exchanger system.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
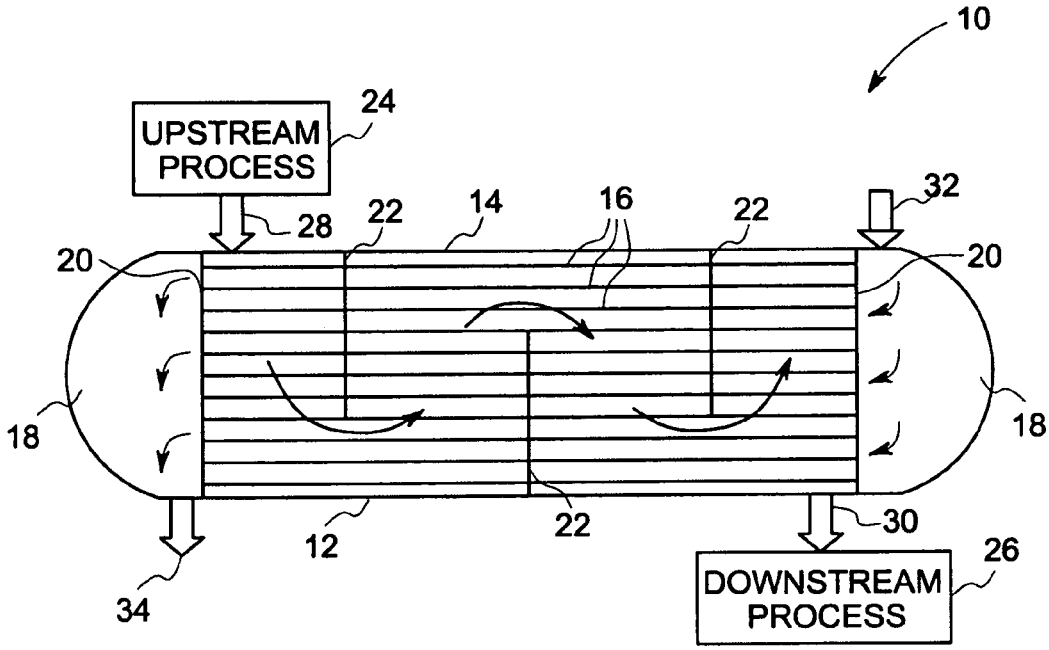
FIG. 1 is a schematic representation of a heat exchanger system of a type for which fouling evaluation may be performed in accordance with the present techniques.

Turning now to the drawings, and referring first to FIG. 1, a heat exchanger system 10 is illustrated as including a heat exchanger 12. In the illustrated embodiment, the heat exchanger 12 is of the shell-and-tube type in which two fluids are introduced for the transfer of thermal energy there between. It should be noted, however, that the present techniques are applicable to any type of heat exchanging system in which fouling may be an issue during its operative life. Such designs may include plate heat exchangers, among many others. Moreover, while in the present discussion reference is generally made to liquid phase fluids in which heat transfer may be characterized by sensible heat changes (i.e., as indicated by changes in temperature), the present techniques may be applied more generally to heat exchanging systems in which phase changes occur. In such systems, latent heat of vaporization results that may be characterized by changes in pressure or volume flow rate, for example. Such systems may include both evaporators and condensers. Similarly, certain systems may function in multiple modes and mixed modes.

In the system 10 illustrated in FIG. 1, a shell 14 forms a closed vessel in which a plurality of tubes 16 extend between end caps 18. Tube sheets 20 isolate volumes within the end caps from a central volume of the shell, with the interior of the tube being in fluid communication with the volumes defined between the end caps and the tube sheets. Baffles 22 may divide the central volume of the shell to create a circuitous flow path for fluids introduced into the shell. As will be appreciated by those skilled in the art, the tubes may be interlinked to define multiple passes through the central volume, or a single pass may be defined by the tubes between the end caps.

When placed into the system 10, the heat exchanger 12 is linked to an upstream process and to a downstream process, as designated generally by reference numerals 24 and 26, respectively. It should be appreciated that many and varied processes may be serviced by the heat exchanger system 10, and the present technique is not limited to any particular process or type of process. The upstream process 24 produces a process stream that forms a first fluid input flow 28, routed through the shell central volume in the illustrated implementation. The flow then exits the heat exchanger 12 as a first fluid output flow 30, to enter the downstream process 26.

A second fluid input 32 is introduced into the heat exchanger 12, as into one of the end cap volumes in the illustrated embodiment, and exits the exchanger as a second fluid output 34. A second fluid flows through the tubes 16 in the shell-and-tube embodiment illustrated. In a typical implementation, the second fluid flows either in the same direction as the first fluid, or in an opposite direction, depending upon the heat change regime desired. Of course, where return flows are provided in the exchanger, more complex thermal gradients may be implemented.

In a typical implementation, a process fluid flowing through the shell may be a hot fluid for which cooling is desired. The second fluid may be treated water at a cooler temperature than the process fluid, such that thermal energy flows from the process fluid to the water. However, such a typical implementation is but one of many possibilities, and is mentioned here as an example only. In other implementations, the process fluid may be heated rather than cooled, and the fluids may include various liquids, gases, molten metals, plastics, and so forth, to mention but a few.

Figure 2:
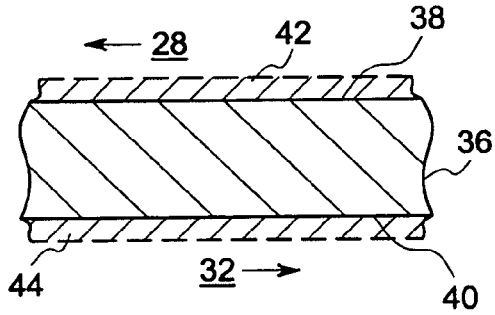
FIG. 2 is a detail view of a portion of a fluid barrier of the heat exchanger system of FIG. 1 illustrating thermal barriers as the device fouls.

In general, the fluids between which thermal energy flows in the heat exchanger system are separated by a thermal barrier, as illustrated generally in FIG. 2. The thermal barrier 36 may be, for example, a wall of a tube in the shell-and-tube heat exchanger 12 of FIG. 1. The barrier 36 separates flowing fluids 28 and 32 from one another, but permits and promotes the exchange of thermal energy between the fluids. The barrier 36 presents surfaces or interfaces 38 and 40 over which the fluids 28 and 32 flow, respectively. As the heat exchanger fouls over time, as discussed in greater detail below, various materials may be deposited or form on one or both of the surfaces 38 and 40, as represented designated generally by reference numerals 42 and 44 in FIG. 2.

Figure 3:
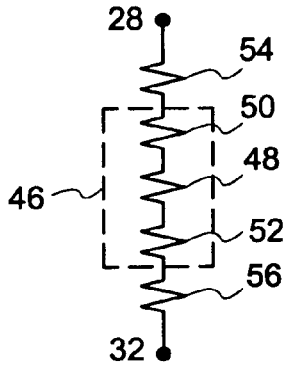
FIG. 3 is a thermal resistance diagram for the thermal barriers of FIG. 2.

The barrier 36, each of the interfaces 38 and 40, and the fouling materials 42 and 44 present impediments to the flow of thermal energy between fluids 28 and 32. Such resistances to the flow of heat establish thermal gradients between the fluids that may change over time, as the heat exchanger becomes increasingly fouled, thereby reducing its effectiveness. FIG. 3 illustrates an effective analogous resistance network for these elements of the thermal system.

The initial design for the thermal barrier 36 effectively establishes what may be referred to as a "clean system" 46 comprising resistances 48, 50 and 52. These resistances generally correspond to the resistance to thermal transfer offered by the barrier 36, and interfaces 38 and 40, respectively. As fouling progresses over time, resistances 54 and 56 gradually increase, as materials 42 and 44 are deposited or form on the interface surfaces 38 and 40 (see FIG. 2). The progressive fouling of the heat exchanger system 10 has many detrimental effects, including the loss of effectiveness of the system, adverse consequences on the upstream and downstream processed (i.e., deviations from the design performance), and even damage or failure of the heat exchanger 12 or its components.

It has been determined that a number of factors may contribute to fouling one or both sides of the thermal barrier 36 and on the interfaces of heat exchangers. Such factors may include precipitation, particulate deposition, chemical reactions of fluid with one another and with materials of the exchanger system, corrosion and biological growth. As will be appreciated by those skilled in the art, the classical Kern and Seaton fouling model dictates that the fouling rate of buildup is a function of the rate of deposit of fouling materials and the rate of their removal. These rates, in turn, are a function of a number of variables, such as the fluid chemistry (typically cooling water chemistry in water-cooled systems), the operating temperatures and conditions, and the metallurgy of the system. While fouling may, to a limited degree, be predicted from such factors, it has been found by the present technique that actual fouling factors for both sides of the thermal barrier may be determined, and based upon such determinations, the rate of fouling, diagnoses as to the causes of fouling, and recommended corrective actions may be identified.

Figure 4:
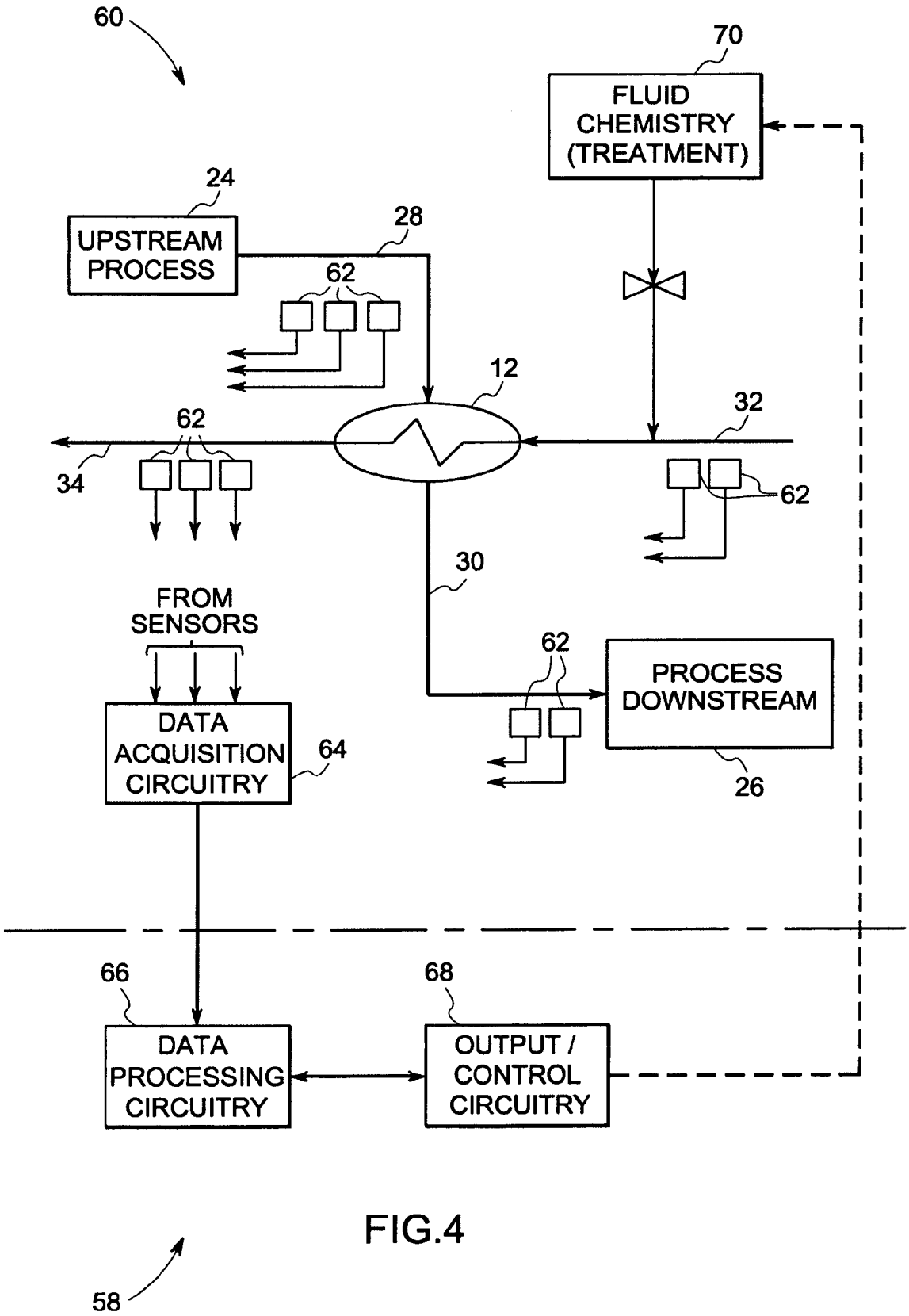
FIG. 4 is a diagrammatical representation of a heat exchanger monitoring system implemented by the present technique.

FIG. 4 is a diagrammatical view of an exemplary heat exchanger monitoring system 58 in accordance with the present technique, for performing some or all of these functions. As shown, the system 10 generally includes a heat transfer system, designated generally by the reference numeral 60, and that includes a heat exchanger 12 coupled to processes as set forth above. The heat transfer system 60 includes sensors, transducers, and other parametric indicators, indicated generally by the reference numeral 62. Depending upon the available information and the system design, sensors 62 may include temperature, flow rate, pressure and other transducers. Many such sensors 62 are available and the appropriate sensors are typically selected based upon the operating conditions of the system and the fluids flowing through the heat exchanger. Moreover, certain of the sensors may be non-intrusive or in-line sensors, permitting the system to be used with virtually any type of heat exchanger system, including operating systems. In many cases, the entire system 10 may be installed and operated without the need to shut down the process, or with only minimal shutdowns for installation of certain of the sensing devices.

Sensors 62 generate analog or digital signals representative of the monitored parameters, and applied these signals to data acquisition circuitry 64. While not shown specifically, the acquisition circuitry 64 may be part of an overall monitoring and control system and may include a variety of signal conditioning circuits, operator interfaces, input and output devices, programming and workstations, memory devices for storing programs and acquired parameter data, and so forth. The data acquisition circuitry 64 is, in turn, linked to data processing circuitry 66 that serves to monitor and analyze performance of the heat exchanger system as described below. Output and control circuitry 68 may also be provided for reporting results of such performance analysis and, where desired, for actually controlling certain of the operating parameters of the system, such as the injection of treatments into one or both of the process streams, as indicated at reference numeral 70 in FIG. 4.

The present technique, then, is adapted to filter the acquired data and to identify "fouling factors" from the data. In general, as used herein, the term "fouling factor" means values characterizing a degree or type of loss of heat transfer effectiveness in the heat exchanger. In a present embodiment, individual fouling factors may be determined for both sides of the thermal barrier, corresponding generally to the resistances 54 and 56 discussed above with reference to FIG. 3. An overall fouling factor may also be developed that is reflective of the overall system performance. Moreover, as described below, techniques such as a Bayesian network may provide an indication of the likely cause or causes of the fouling for identification of corrective actions. Based upon identified trends over time, a model of fouling may also be selected to more accurately predict future fouling, actions required, maintenance procedures, treatments, and so forth.

Figure 6:
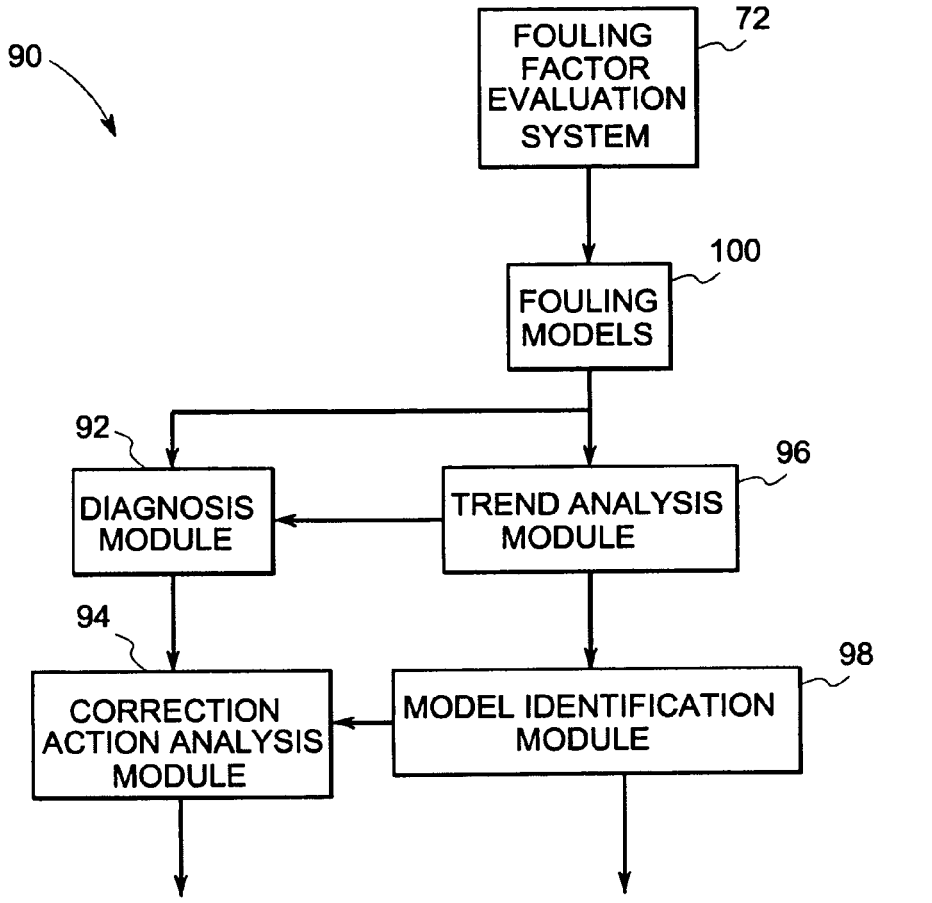
FIG. 6 is a block diagram of modeling and diagnostic system for characterizing fouling of a heat exchanger in connection with the evaluation system of FIG. 5.

As shown in FIG. 6, a fouling factor evaluation system 72 draws information from the heat exchanger system or plant 60 described above, and includes a number of components and modules. These may generally be considered as being within the data processing circuitry 66, or the output and control circuitry 68 described above with reference to FIG. 4. As will be appreciated by those skilled in the art, such circuitry will generally include appropriate code executed on a programmed application-specific or general-purpose computer, as well as any hardware or firmware required for performing the functions described herein.

A smoothing filter 74, such as a median filter, first removes anomalous data points from the acquired data. In particular, filter 74 may remove such data outliers occurring from time to time due to, for example, process variations, special conditions, and so forth, to provide more reliable and indicative data. A measurement noise reduction filter 76, then, reduces measurement noise so as to provide a more true and temporally comparative set of data. In a present embodiment, a Kalman filter is preferred for this purpose.

Once filtered the data may be stored for processing. A benefit of the present technique is the ability to provide real time, or near-real time evaluation of the state and trends in fouling of the heat exchanger, however. Thus, the data are provided to a series of fouling predictors or evaluation modules (typically implemented as software code), including a fouling predictor momentum balance module 78, a fouling predictor energy balance module 80, and a fouling factor predictor module 82. It has been found in the present technique, that the use of momentum balance module 78 and energy balance module 80 enhances discrimination and characterization of the individual fouling occurring on both surfaces of the thermal barrier (typically the inner and outer surfaces of heat exchanger tubes in a shell-and-tube structure).

For example, in a shell-and-tube system, the momentum balance may provide that the measured change in pressure through the tube side of the system 10 is determined by the relationship:

$$\Delta p = \frac{4fl\rho v^2}{2g_c d_c};$$

where $\Delta p$ is the pressure drop through the exchanger, f is a friction factor for the flow surface within the exchanger, l is the length, $\rho$ is the density of the liquid flowing, v is the fluid velocity, $g_c$ is the gravitational constant, and $d_c$ is the effective diameter of the flow path (in the shell-and-tube implementation). Similar formulations are available, of course, for other flow paths and configurations. In the example given, the pressures upon which the calculations are based will be sensed, and other values will generally be known or assumed.

Similarly, the energy balance module 80 implements energy balance analysis based upon sensed parameters. In a present embodiment, and for sensible heat transfer implementations, the module 80 may compute the heat transfer $Q_s$ from the fluid on the shell side of the shell-and-tube system, in the illustrated embodiment, in accordance with the relationship:

$$Q_s=F_sC_{ps}(T_{si}-T_{so});$$

where $F_s$ is the flow rate through the shell side, $C_{ps}$ is the specific heat of the fluid flowing on the shell side, and $T_{si}$ and $T_{so}$ are the sensed temperatures of the shell input flow and shell output flow, respectively.

Similarly, the heat transfer rate $Q_t$ may be computed from the relationship:

$$Q_t=-F_tC_{pt}(T_{ti}-T_{to});$$

where $F_t$ is the flow rate though the tube side, $C_{pt}$ is the specific heat of flowing on the tube side, and $T_{ti}$ and $T_{to}$ are the sensed temperatures of the tube input flow and tube output flow, respectively.

Figure 5:
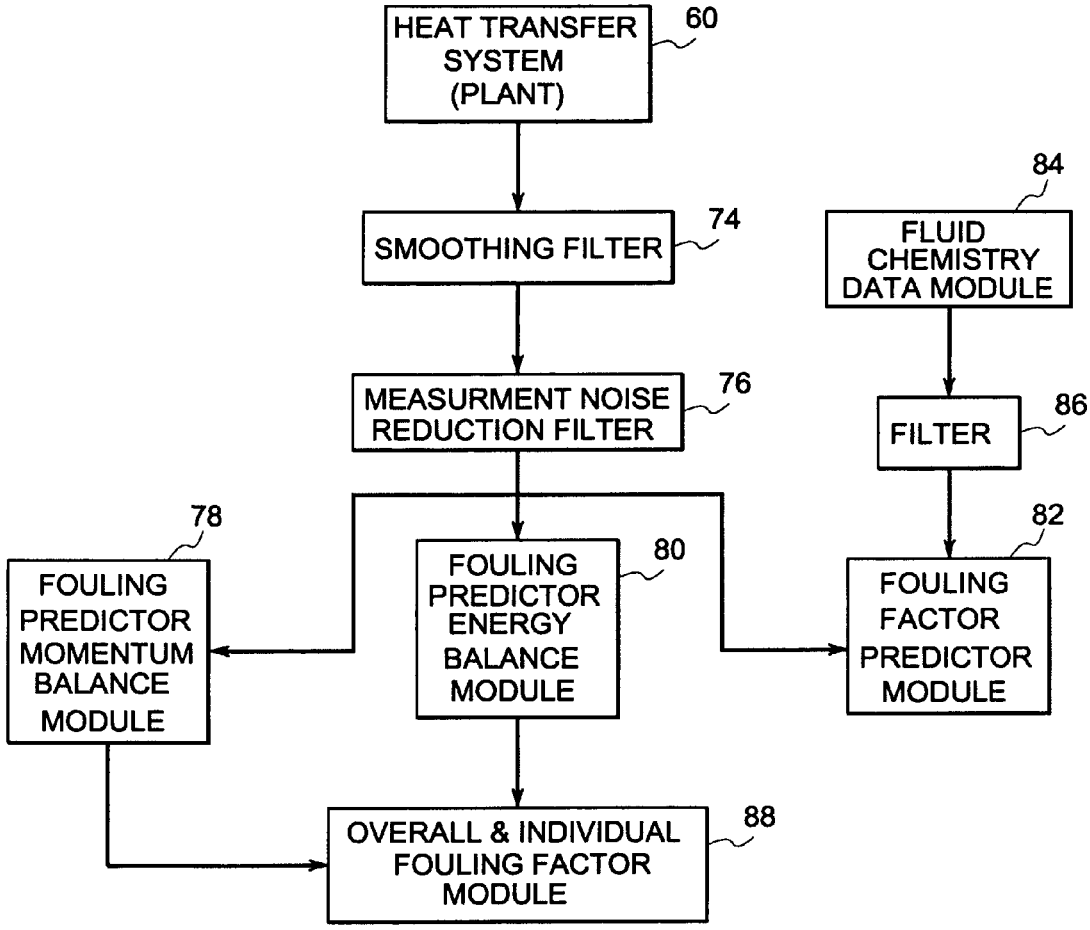
FIG. 5 is a block diagram of a fouling factor evaluation system in accordance with aspects of the present technique.

It should also be noted that, in practice, the processing modules of FIG. 5 may include a data reconciliation module upstream of or within the energy balance module to impose the condition that $Q_s=Q_t$ as a physical constraint of the system.

Depending upon the implementation of the system (e.g. counterflow, or other profiles), the heat transfer value may then be used to determine the heat transfer coefficient of the fouled or dirty system, in accordance with the relationship:

$$Q=U_DA\Delta T_{LM};$$

where $U_D$ is the fouled system heat transfer coefficient, A is the surface area available for heat transfer, and $\Delta T_{LM}$ is the log mean temperature difference (assumed for counter-current action in this case). The particular implementation may alter the values used for these calculations, however, such as to provide corrected area or temperature difference values.

Similarly, based upon heat transfer coefficients for the inside and outside of the tubes, the heat transfer value UC of the clean or unfouled system may be computed form the relationship:

$$\frac{1}{U_C}=\frac{1}{hio}+\frac{1}{ho}+\Delta t_{tubethk}/k_{condwall};$$

where $h_{io}$ and $h_o$ are the heat transfer coefficients of the inside of the tubes (corrected, where appropriate for inside-to-outside diameters) and of the outside of the tubes, respectively, $\Delta t$ is the wall thickness, and k is the thermal barrier (i.e. wall) conductivity.

Based upon the heat transfer coefficients, then, fouling factors for the tube and shell sides of the system, $f_t$ and $f_s$ respectively, may be computed form the relationship:

$$\frac{1}{U_D}=\frac{1}{U_C}+f_t+f_s.$$

It may be noted that in the foregoing computations, the resistances 48, 50 and 52 discussed with respect to FIG. 3 generally correspond to $\Delta t/k$, $1/h_{io}$, and $1/h_o$ respectively. Similarly, the values $f_{io}$ and $f_o$ correspond to the thermal flow resistances of the inside and outside fouling, 54 and 56, respectively.

In accordance with the momentum and energy balances, then fouling factors may be determined for both sides of the system. As will be appreciated by those skilled in the art, the pressure differential for each fluid as it flows through the system will generally increase with fouling, while the rate of energy transfer will drop. The use of both momentum and energy balance modules 78 and 80 permits separation of the fouling factors. That is, based upon the momentum balance, a tube side hydraulic fouling factor $f_{ht}$ is determined, along with a shell side hydraulic fouling factor $f_{hs}$. These factors will generally result from reductions in flow areas, and are characterized through the momentum balance computations of the type described above.

The energy balance determinations, then, in practice, identify tube side energy-based and shell side energy-based factors. The use of both balances, however, permits fouling factors to be distinguished for each heat transfer surface, as will be appreciated by those skilled in the art.

Returning to FIG. 5, the fouling factor predictor module 82, in addition to receiving filtered sensed data, may receive data indicative of the chemistry of one or both of the heat exchange fluids, and typically of treated water in a water-cooled system. Thus, a fluid chemistry data module 84 may be implemented for inputting or sensing parameters of the fluid, such as recirculation rate, temperature range, approach temperature, pH, conductivity, turbidity and any other real-time or periodically sensed parameters. Moreover, the module 84 may include manually input data, such as properties of treatments and treatment chemistry. A filter 86 may be used to filter this data, such as to smooth anomalous spikes or changes in the data.

Fouling factor predictor module 82, then, may estimate the effects of the fluid chemistry on the current and future fouling of the system. Such estimations may be based upon known characteristics or tendencies of the fluids to deposit or to precipitate fouling materials, to react with or to corrode materials of the system, or to permit or inhibit microbial growth. Module 88, then, allows for computation of overall and individual fouling factors so as to provide an indication of performance of the system, fouling of the individual heat transfer surfaces, both with and without changes in treatment of the fluids.

Based upon such analysis, the system may be evaluated to determine the probable root causes of fouling, to propose corrective actions, and to forecast future fouling. FIG. 6 illustrates an exemplary fouling modeling and diagnostics system 90 that may be implemented, again, typically through appropriate programming code. A diagnosis module 92 allows for determination of the probable root causes of fouling. In a preferred embodiment, a Bayesian network is implemented that captures cause and effect relationships between operating parameters and fluid data, and possible resulting fouling.

The Bayesian network may be developed from a variety of data sources, such as initially from input from domain experts. The relationships are then validated and tuned with field data from operating plants and sites, and from laboratory experimental results. Resulting data is preferably taken from multiple sources, including both on-line and off-line data around the heat exchanger and cooling fluid systems, as well as relating to environmental conditions. Examples of such data and, data collection and analysis techniques include pH, ion analyses, ATP, metallurgy information, shell versus tube side water data, cooling tower fill data, treatment chemistry data, and so forth.

The data are typically first processed through a data analysis module to generate evidence required by the Bayesian network. Various techniques can be used to generate the evidence from data, including statistical techniques, physical models, regression models, time series analyses, and so forth. A reasoning engine, containing the data analysis system and Bayesian network, is used to acquire data from a repository, transform the data into evidence, and insert evidence into the Bayesian network. The a posteriori beliefs for the hypothesis variables in the network are extracted and presented to a user for interpretation, together with the evidence used to reach those results. Based upon diagnostic and prognostic results, then, from the reasoning engine, appropriate recommendations for treatments or other corrective actions or maintenance of the system may be provided, as indicated at the corrective action analysis module 94 of FIG. 6. It should be appreciated, however, that where appropriate, such actions may be identified by other mechanisms than the Bayesian network discussed above.

The system 90 also permits the identification of trends in fouling though the trend analysis module 96. In general, module 96 monitors trends in the fouling factors determined by the system, and may process the fouling factors (e.g. by curve fitting routines, to identify progression (or reduction) in the fouling factors. Based upon these trends, a model for fouling may then be identified by a model identification module 98. The module 98 matches the trends to one of a range of available models for fouling, or may adapt or develop a model for the application. As will be appreciated by those skilled in the art, for example, several fouling models have been proposed in the art, and data descriptive of these may be stored in a repository, as represented generally by reference numeral 100 in FIG. 6.

Figure 7:
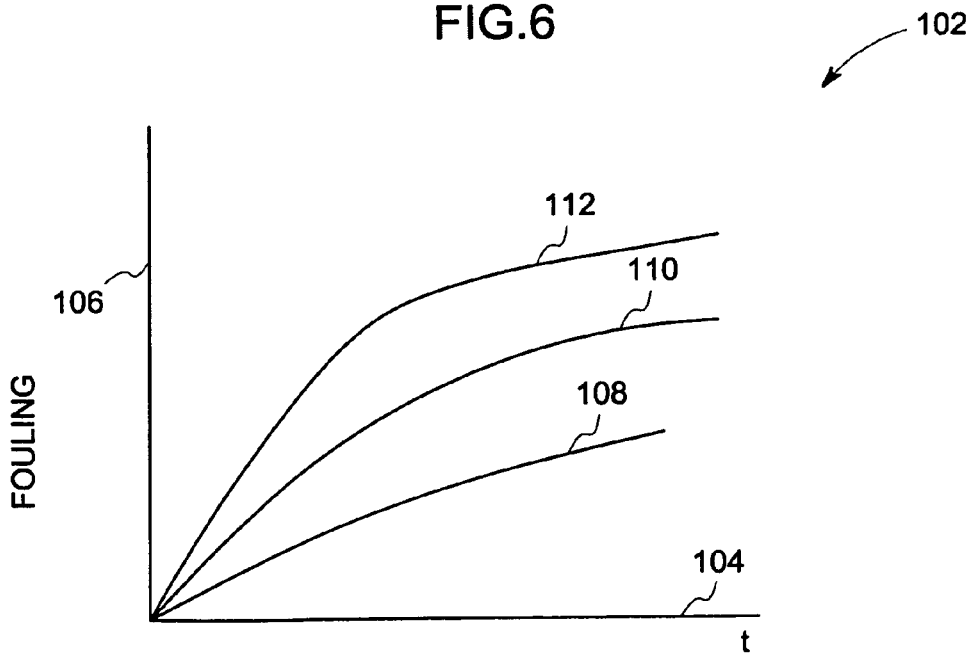
FIG. 7 is a graphical representation of fouling progression in accordance with different fouling models identifiable via the analysis techniques presented herein.

FIG. 7 graphically illustrates trends in fouling in accordance with certain proposed fouling models. In FIG. 7 the characteristic progression of fouling in each model, together represented by the reference numeral 102, are displayed along a time axis 104 and a fouling axis 106. A first, linear model illustrated by trace 108 generally exhibits a progression of fouling that is proportional to time. In a second model 110 fouling progresses exponentially, eventually becoming relatively constant following a period of relatively rapid increase. Finally, in a quadratic model 112, fouling increases at a rate that is a function of the square of time. It should be noted that the models illustrated in FIG. 7 are provided herein as examples only. Other models or combinations of characteristic base models, may, of course, be matched to the determined rates of fouling.

As noted above, the present technique permits many parameters to be accessed and evaluated to determine possible causes of fouling, corrective actions available to reduce fouling, and trends and models of fouling. The data accessed and evaluated may, as also noted above, be collected automatically, such as in real time or near real time with the performance evaluation made as described. Moreover, a number of factors, such as relating to the condition of the fluids and the chemistry (e.g. water treatment) of the fluids may also be collected and evaluated, being input either automatically, semi-automatically, or manually.

The table below provides a non-exhaustive listing of certain characteristic parameters that may be considered in evaluating fouling, the causes of fouling and possible corrective actions in accordance with the present techniques.

| Key parameters to identify causes and actions for fouling in heat exchangers | |
|---|---|
| | Label |
| Water Contamination (dissolved Solids) | |
| | calcium phosphate saturation index |
| | LSI saturation index |
| | total organic content |
| | delta phosphate |
| Water Contamination (Microbial Growth) | |
| | Algae/Fungal growth on the Cooling Towers |
| | SRB count |
| | aerobic bacteria source |
| | oxidizing biocide |
| | planktonic bacteria level |
| | existing biofilm, etc. |
| | planktonic plate count |
| Water Contamination (Suspended Solids) | |
| | Side Stream filtering |
| | CT turbidity |
| Water Contaminanation (Miscellaneous) | |
| | consistency in cycles |
| Cooling System Configuration | |
| | water source |
| | once through water |
| | high heat-transfer temperature |
| Heat Exchanger Configuration | Different parameters specifying a Heat Exchanger |
| | approach temperature |
| | heat transfer coefficient (U) |

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for monitoring performance of a heat transfer system, comprising:

diagnosing a probable root cause of performance degradation of a heat transfer surface via an automated knowledge based analysis algorithm, based on sensed data accessed from the heat transfer system, including:

performing a momentum balance based upon the sensed data;

performing an energy balance based upon the sensed data; and determining individual performance degradation for the heat transfer surface and overall performance degradation for the heat transfer system based upon the momentum balance and the energy balance.

2. The method of claim 1, wherein the automated knowledge based analysis algorithm comprises a Bayesian network.

3. The method of claim 1, wherein the sensed data is accessed at different points in time or at different locations in the system.

4. The method of claim 1, further comprising performing a quality enhancement of the sensed data by applying a measurement noise mitigation algorithm on the sensed data.

5. The method of claim 1, further comprising predicting performance degradation of the heat transfer surface based upon performance degradation determined at different points in time.

6. The method of claim 5, wherein predicting the performance degradation comprises utilizing a multi-model adaptive approach to predict a trend of performance degradation based on the performance degradation determined at different points in time.

7. The method of claim 1, further comprising determining a corrective action to reduce or limit performance degradation based on the determined performance degradation.

* * * * *